US005561906A

United States Patent [19]

Desmarais

[11] Patent Number: 5,561,906

[45] Date of Patent: Oct. 8, 1996

[54] CARPET KNIFE

[76] Inventor: Armand R. F. Desmarais, 222 Farm St., Woonsocket, R.I. 02895

[21] Appl. No.: 517,250

[22] Filed: Aug. 21, 1995

[51] Int. Cl.[6] ..... B26B 5/00

[52] U.S. Cl. ..... 30/339; 30/317

[58] Field of Search ..... 30/125, 329, 337, 30/339, 335, 314, 317, 162; 7/103

[56] References Cited

U.S. PATENT DOCUMENTS

| | | | |
|---|---|---|---|
| 2,120,960 | 6/1938 | Arthur . | |
| 2,376,887 | 5/1945 | Walters . | |
| 2,862,296 | 12/1958 | Anderson | 30/162 |
| 3,660,895 | 5/1972 | West | 30/162 |
| 3,927,473 | 12/1975 | Braginetz | 30/125 |
| 4,068,375 | 1/1978 | Rathbun et al. | 30/125 |
| 4,419,029 | 12/1983 | Wenzel . | |
| 4,524,518 | 6/1985 | West | 30/330 |
| 4,574,940 | 3/1986 | Wenzel | 30/335 |
| 4,604,805 | 8/1986 | Krieger | 30/125 X |
| 4,713,884 | 12/1987 | Dunnagan | 30/317 X |
| 4,910,821 | 3/1990 | Kieferle | 7/158 |
| 4,974,320 | 12/1990 | Pelletier | 30/123 |
| 5,174,028 | 12/1992 | Seltzer, Jr. | 30/337 |

*Primary Examiner*—Hwei-Siu Payer
*Attorney, Agent, or Firm*—Salter & Michaelson

[57] ABSTRACT

A carpet knife for creasing carpet at the juncture of the floor and the wall, and for cutting carpet along the crease, includes a split body having first and second mating body sections which when in assembled relation include a forward end portion which is capable of receiving and securing thereto a blade to cut carpet, a handle portion which is grasped in the user's hand, and a rearward end portion which is tapered to a pointed end. The rearward end portion is designed to crease the carpet at the juncture of the floor and the wall.

6 Claims, 3 Drawing Sheets

CARPET KNIFE

BACKGROUND AND SUMMARY OF THE INVENTION

This invention relates generally to utility knives, and more particularly to a dual-purpose carpet knife which is capable of creasing and cutting carpet.

Utility knives for cutting articles, such as carpet, drywall and many other articles, are well-known in the art. For example, U.S. Pat. No. 2,120,960 to Arthur, U.S. Pat. No. 2,376,887 to Walters, U.S. Pat. No. 4,419,029 to Wenzel, U.S. Pat. No. 4,524,518 to West, U.S. Pat. No. 4,575,940 to Wenzel, U.S. Pat. No. 4,910,821 to Kieferle, U.S. Pat. No. 4,974,320 to Pelletier, and U.S. Pat. No. 5,174,028 to Seltzer, Jr. are representative of the available prior art. Several of these patents disclose dual-purpose utility knives. For example, the patent to Kieferle discloses a knife having a cutting blade at one end thereof and a screen forming wheel at its other end. Similarly, the patent to Pelletier discloses a knife having a cutting blade at one end and a toothed cutting wheel at its other end.

However, none of these patents disclose a utility knife which is especially designed for creasing carpet at the juncture of the floor and the wall, and for cutting carpet at said juncture. Presently, a carpet installer requires two separate tools in order to crease and cut carpet. One tool has a handle portion and an end portion shaped to have a straight edge whereby the installer creases the carpet with the straight edge of the tool. After creasing the carpet, the installer cuts it with a separate tool, i.e., a utility knife. There is presently a need for a dual purpose carpet knife in which the carpet installer can both crease the carpet and cut it.

Accordingly, among the several objects of the present invention are the provision of an improved carpet knife which is capable of serving the dual purpose of creasing carpet and cutting it thereby eliminating the need of having two separate tools to perform these functions; the provision of such a carpet knife which has relatively few component parts; the provision of such a carpet knife which is easy to assemble; and the provision of such a carpet knife which is durable in use and cost-efficient to manufacture.

In general, the present invention is directed to a carpet knife constructed and arranged for creasing carpet at the juncture of the floor and the wall, and for cutting carpet along the crease. The carpet knife comprises a split body having first and second mating body sections which when in assembled relation include a forward end portion having means for receiving and securing thereto a blade to cut carpet, a handle portion which is adapted to be grasped in the user's hand, and a rearward end portion which is tapered to a pointed end. The rearward end portion is adapted to crease the carpet at the juncture of the floor and the wall.

In a preferred embodiment of the present invention, the first and second body sections each have inwardly facing surfaces which are adjacent each other when the sections are in assembled relation. One of the first and second body sections has an outwardly extending, elongated rib formed on its surface which is received in a corresponding recess formed in the other of the first and second body sections for preventing relative movement of the body sections when the sections are assembled. Moreover, the blade receiving and securing means comprises another outwardly extending, elongated rib formed on the inwardly facing surface of one of the first and second body sections at the forward end portion. The rib is received in a corresponding recess formed in the other of the first and second body sections. The rib is adapted to extend through an opening formed in a blade for securing the blade to the carpet knife when the mating sections are assembled.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
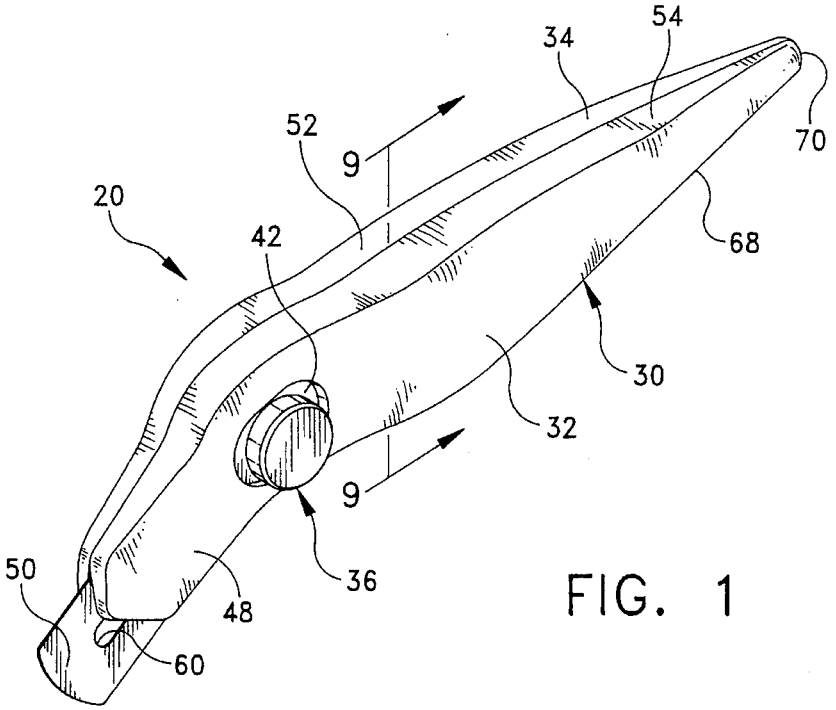
FIG. 1 is a perspective view illustrating a carpet knife of the present invention.
Figure 10:
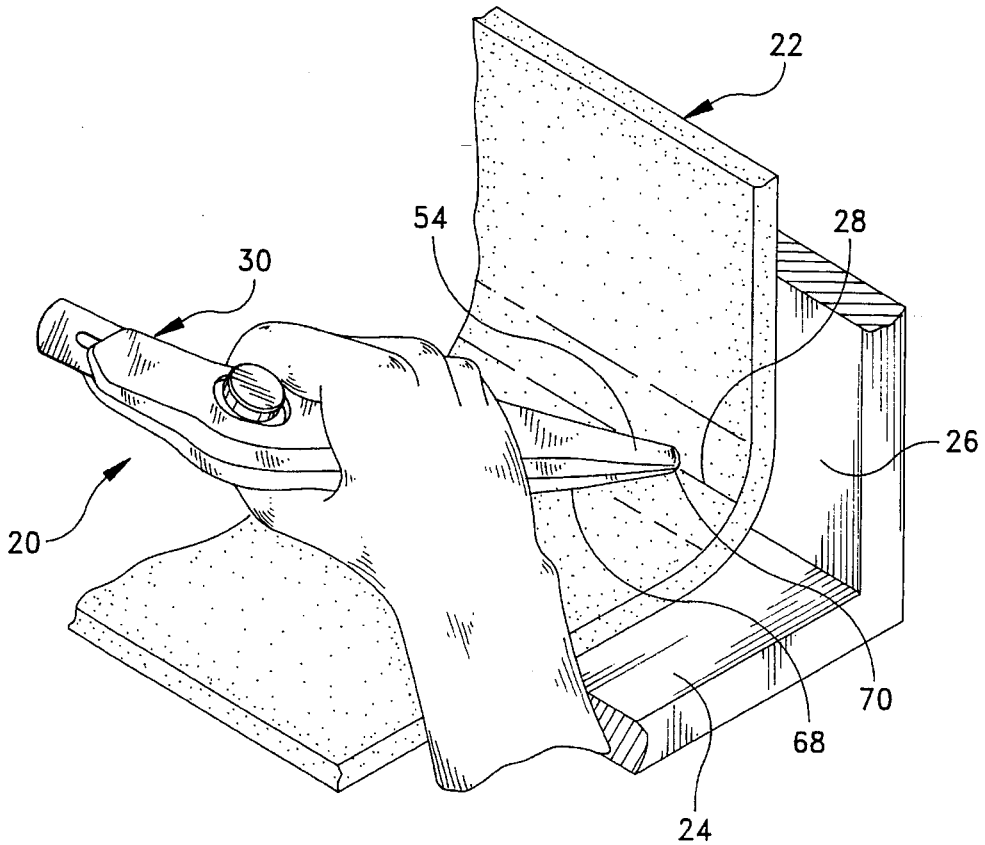
FIG. 10 is a perspective view of the carpet knife illustrating it being used to crease carpet using a forwadly motion.

Referring now to the drawings, and more particularly to FIGS. 1 and 10, there is generally indicated at 20 a carpet knife of the present invention. The carpet knife 20 is especially suited for the dual-purpose of creasing carpet generally indicated at 22 (see FIG. 10) at the junction of a floor 24 and a wall 26, and for cutting the carpet 22 along the crease 28. It should be understood that reference to the floor and the wall applies to any location where the carpet requires creasing and not just to the junction of a "floor" and a "wall".

Figure 2:
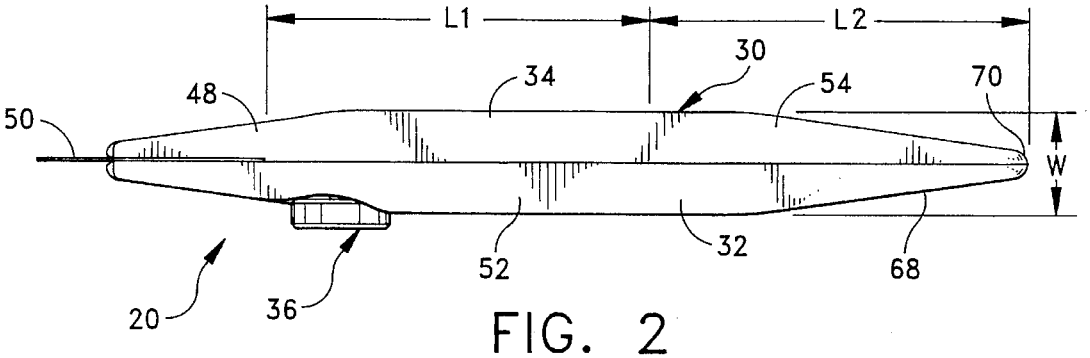
FIG. 2 is a top plan view thereof.

Turning generally to FIGS. 1–9, the carpet knife 20 comprises a split body generally indicated at 30 having first and second mating body portions 32, 34 which are held together in assembled relation by a thumb turn screw generally indicated at 36. Both body sections 32, 34 have respective inwardly facing surfaces 38, 40 which are adjacent each other when the body sections 32, 34 are assembled. As illustrated in FIG. 2, there is a recessed area 42 formed in the outer surface body section 32 which surrounds an opening 44 formed therethrough (see also FIG. 6). There is a corresponding tapped opening 46 formed in the other body section 34 which threadably engages the thumb turn screw 36. This type of construction is well-known in the art of utility knives and reference can be made to any number of the above-identified prior art patents for this construction. However, one important advantage the carpet knife 20 of the present invention has over these prior art knives is that by providing a thumb turn screw 36, it can be assembled and disassembled by tightening and loosening the thumb turn screw 36 by hand thereby obviating the need of using a tool (such as a screwdriver) for accomplishing these steps.

Figure 3:
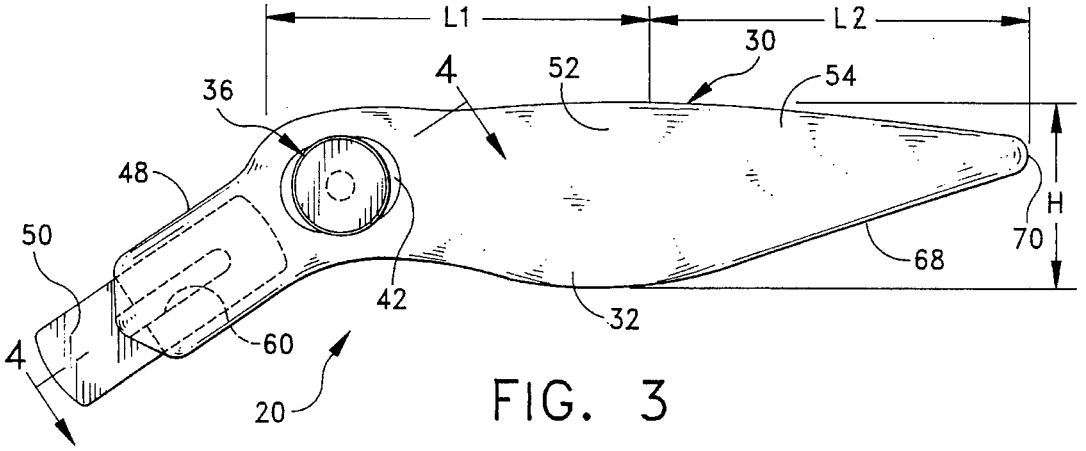
FIG. 3 is a side elevational view thereof.
Figure 4:
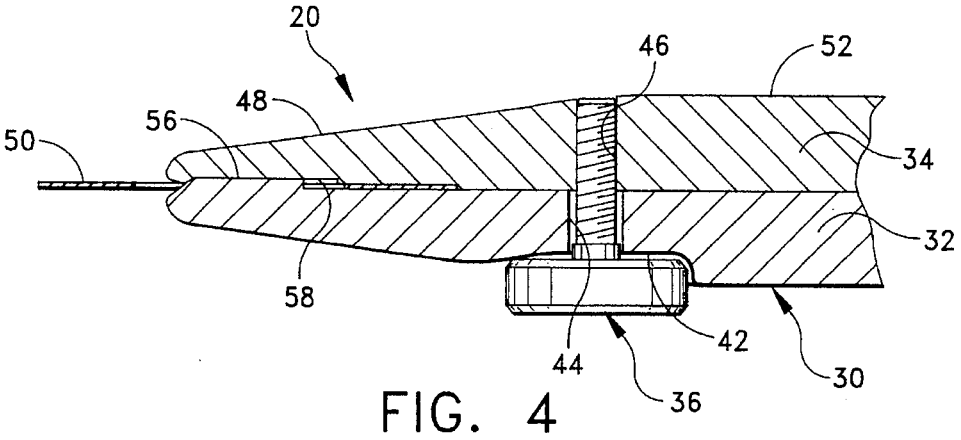
FIG. 4 is a cross-sectional view taken along line 4—4 of FIG. 3.

When assembled, the body 30 has a forward end portion 48 which receives a blade 50 similar to a razor blade, a handle portion 52 which is adapted to be grasped in the installer's hand, and a rearward end portion 54. The handle portion has a length L1 (see FIGS. 2 and 3) for enabling the handle portion to be comfortably grasped in the user's hand in the manner illustrated in FIG. 10. The forward end portion 48 is angled with respect to the handle and rearward end portions 52, 54 as best illustrated in FIG. 3. This angled relationship is provided so that the installer may obtain a better cutting force on the carpet 22 when cutting the carpet along the crease 28, for example.

Figure 5:
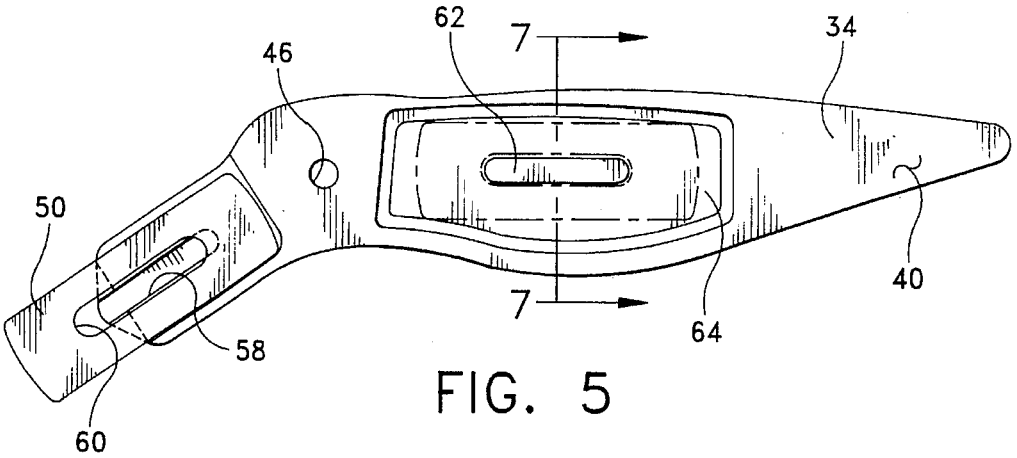
FIG. 5 is a side elevational view of a body section of the carpet knife.
Figure 6:
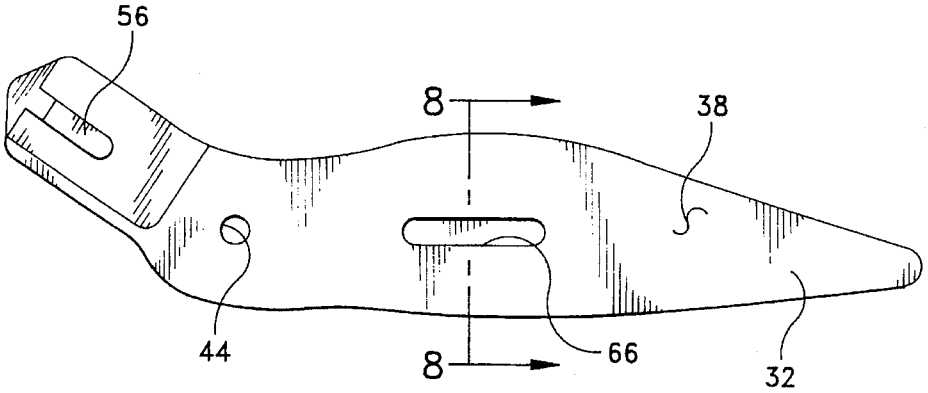
FIG. 6 is a side elevational view of another body section of the knife which is adapted to mate with the body section illustrated in FIG. 5.
Figure 7:
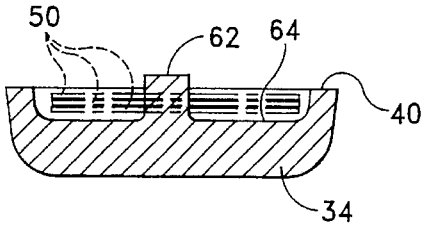
FIG. 7 is a cross-sectional view taken along line 7—7 in FIG. 5.
Figure 8:
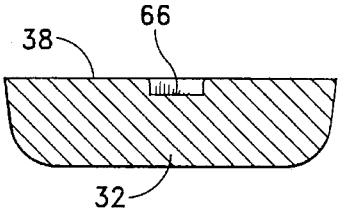
FIG. 8 is a cross-sectional view taken along line 8—8 in FIG. 6.
Figure 9:
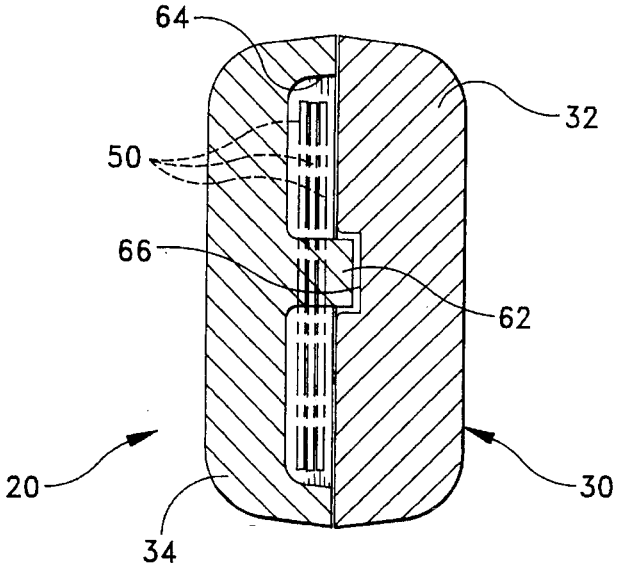
FIG. 9 is a cross-sectional view taken along line 9—9 in FIG. 1.

Turning now to FIGS. 5 and 6, there is means associated with the forward end portion 48 for receiving and securing the blade 50 thereto. Such means comprises an outwardly extending, elongated forward end rib 56 formed on the inwardly facing surface 38 of body section 32, and a corresponding recess 58 formed in the surface 40 other body section 34. The forward end rib 56 is designed so as to be received within the recess 58 when the body sections 32, 34 are assembled. The arrangement is such that the blade 50, which has an elongated opening 60 formed therein that is sized for receiving the forward end rib 56 therethrough, is placed over the forward end rib 56 with the rib extending through the opening 60 of the blade 50 and captured between the two body sections 32, 34 in the manner illustrated in FIGS. 1–5. By tightening the thumb turn screw 36, the blade 50 is secured to the body 30 of the carpet knife 20.

Referring to FIGS. 5–9, there is indicated at 62 an outwardly extending, elongated handle rib formed in the inwardly facing surface 40 of body section 34. Surrounding the rib 62 is a relatively large recessed area 64 also formed in the inwardly facing surface 40 of the body section 34. This recessed area 64 is sized for receiving a plurality of spare blades each also indicated at 50 in the manner illustrated in FIG. 7 in which the rib 62 extends through the openings 60 of the blades 50. The handle rib 62 is received in a corresponding recess 66 formed in the inwardly facing surface 38 other body section 32. The handle rib 62 is designed so as to be received within the recess 66 when the body sections 32, 34 are assembled. The arrangement is such that the spare blades 50 are received in recessed area 64 with the handle rib 62 extending through the openings 60 of the blades 50 and captured between the two body sections 32, 34. By tightening the thumb turn screw 36, the blades 50 are secured to the body 30 of the carpet knife 20 within the body 30. Besides providing a storage area within the carpet knife 20 for storing spare blades 50, the extension of the handle rib 62 into the recess 66 prevents relative movement of the sections 32, 34 when the sections are assembled.

In order to achieve its stated objective of providing a single tool which, in addition to being able to cut carpet, can crease carpet as well, the rearward end portion 54 is tapered at 68 to a pointed end 70 in the manner best illustrated in FIGS. 1–3. As shown, the rearward end portion 54 is tapered in its widthwise dimension W (FIG. 2) and also in its heightwise dimension H (FIG. 3) to its pointed end 70 which is gently curved so as not to damage the carpet 22 during creasing. Also, the rearward end portion 54 of the knife 20 has a lengthwise dimension L2 at least substantially equal to the lengthwise dimension L1 of the handle portion 52 (see FIG. 3) to crease the carpet. This ensures that the user's hand does not interfere with the creasing of the carpet and that the rearward end portion 54 extends from the hand in the manner illustrated in FIG. 10.

FIG. 10 illustrates the manner in which the carpet knife 20 is used during creasing. As shown, the knife 20 is held so that its rearward end portion 54 is directed away from the installer whereby the installer applies a force on the carpet knife 20 which creases the carpet 22 along the juncture of the floor 24 and the wall 26 with the tapered rearward end portion 54. Since the carpet knife 20 is preferably made from solid material (e.g., cast aluminum), it is of sufficient strength to apply an adequate creasing force. After the crease 28 is made, the installer need only reverse the carpet knife 20 and cut the carpet 22 with its blade 50 in the well-known manner along the crease 28.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A carpet knife constructed and arranged for being held in a user's hand, for creasing carpet along a crease, and for cutting carpet along said crease, said carpet knife comprising a split body having first and second mating body sections which when in assembled relation include a forward end portion having means for receiving and securing thereto a blade to cut carpet, a handle portion having a lengthwise dimension to be grasped in the user's hand, and a rearward end portion having a lengthwise dimension, and a widthwise dimension and a heightwise dimension tapered to a pointed end, said lengthwise dimension of the rearward end portion being at least substantially equal to the lengthwise dimension of the handle portion to crease the carpet.

2. A carpet knife as set forth in claim 1, said first and second body sections each having inwardly facing surfaces which are adjacent each other when the sections are in assembled relation, one of said first and second body sections having an outwardly extending, elongated rib formed on its inwardly facing surface which is received in a recess formed in the inwardly facing surface of the other of said first and second body sections for preventing relative movement of the body sections when the sections are assembled.

3. A carpet knife as set forth in claim 1, said forward end portion being angled with respect to the handle and rearward end portions.

4. A carpet knife as set forth in claim 1, said body sections being secured together by a thumb turn screw which is capable of being tightened and loosened by hand for assembling and disassembling the body sections.

5. A carpet knife as set forth in claim 2, said blade receiving and securing means comprising another outwardly extending, elongated rib formed on the inwardly facing surface of one of said first and second body sections at the forward end portion, said rib being received in a corresponding recess formed in the opposing surface of the other of said first and second body sections, said rib being adapted to extend through an opening formed in a blade for securing the blade to the carpet knife.

6. A carpet knife constructed and arranged for being held in a user's hand, for creasing carpet along a crease, and for cutting carpet along said crease, said carpet knife comprising a body including a forward end portion having means for receiving and securing thereto a blade to cut carpet, a handle portion having a lengthwise dimension to be grasped in the user's hand, and a rearward end portion having a lengthwise dimension, and a widthwise dimension and a heightwise dimension tapered to a pointed end, said lengthwise dimension of the rearward end portion being at least substantially equal to the lengthwise dimension of the handle portion to crease the carpet.

* * * * *